US012523125B2

(12) United States Patent
Themig et al.

(10) Patent No.: US 12,523,125 B2
(45) Date of Patent: Jan. 13, 2026

(54) LINER HANGER APPARATUS AND METHOD

(71) Applicant: ROKK ENERGY TECHNOLOGIES INC., Calgary (CA)

(72) Inventors: Daniel J. Themig, Calgary (CA); Jody R. McGlothen, Brighton, CO (US); Jim Fehr, Sherwood Park (CA)

(73) Assignee: Rokk Energy Technologies Inc., Calgary (CA)

( * ) Notice: Subject to any disclaimer, the term of this patent is extended or adjusted under 35 U.S.C. 154(b) by 0 days.

(21) Appl. No.: 18/667,331

(22) Filed: May 17, 2024

(65) Prior Publication Data

US 2024/0384629 A1 Nov. 21, 2024

Related U.S. Application Data

(60) Provisional application No. 63/502,992, filed on May 18, 2023.

(51) Int. Cl.
*E21B 43/10* (2006.01)
*E21B 23/01* (2006.01)

(52) U.S. Cl.
CPC ..... *E21B 43/103* (2013.01); *E21B 23/01* (2013.01)

(58) Field of Classification Search
CPC ..... E21B 43/103; E21B 23/00
See application file for complete search history.

(56) References Cited

U.S. PATENT DOCUMENTS 3,344,862 A * 10/1967 Conrad ..... E21B 23/006 166/243
2012/0234530 A1* 9/2012 Tait ..... E21B 41/00 166/66.5
2016/0102522 A1* 4/2016 Martin ..... E21B 33/1292 166/387
2023/0392469 A1* 12/2023 Molzahn ..... E21B 23/0413

* cited by examiner

*Primary Examiner* — Tara Schimpf
*Assistant Examiner* — Daniel T Craig
(74) *Attorney, Agent, or Firm* — Kunzler Bean & Adamson

(57) ABSTRACT

A liner hanger apparatus, comprising: a body including an inner bore, an outer surface, a wall between the inner bore and the outer surface and a tapered segment on an outer surface of the body; a plurality of slips disposed on the outer surface of the body, the plurality of slips being actuatable to move from an unset position adjacent a small diameter end of the tapered segment to a set position on the tapered segment of the body to increase a diameter of the apparatus; a locking mechanism to hold the plurality of slips in the unset position; and an actuation system to unlock the locking mechanism, wherein the actuation system involves mechanisms of operation other than hydraulic fluid communication through the wall, such that the body is thereby free of hydraulic ports extending through the wall.

13 Claims, 24 Drawing Sheets

LINER HANGER APPARATUS AND METHOD

CROSS REFERENCE

This application claims priority to US 63/502,992, filed May 18, 2023.

BACKGROUND

Resource extraction operations, e.g., oil and gas drilling, often involve liner hangers and installation thereof.

Liner hangers of the prior art include hydraulic systems for securing the body of the liner hanger to casing down hole. Specifically, liner hanger setting slips are expanded out by communicating hydraulic fluid from within the liner hanger body to a hydraulic actuating system for the slips.

Because hydraulic components can degrade, hydraulic penetrations through the liner hanger wall can become leak points through the liner hanger. Hydraulic penetrations extend from the liner hanger body inner diameter to the body wall outer surface and, for example, include hydraulic fluid ports that extend through the liner hanger body wall or elastomerically sealed interfaces that penetrate the liner hanger body wall or are external to the hydraulic fluid ports.

Liner hangers of the prior art sometimes are set by moving the liner hanger body relative to the wellbore wall. This limits the accuracy of the setting location and complicates the securing process.

SUMMARY OF INVENTION

In accordance with a broad aspect of the present invention, there is provided a liner hanger, comprising: a body including an inner bore, an outer surface, a wall between the inner bore and the outer surface and a tapered segment on the outer surface; a plurality of slips disposed on the outer surface of the body, the plurality of slips being actuatable to move from an unset position adjacent a small diameter end of the tapered segment to a set position on the tapered segment of the body to increase a diameter of the apparatus; a locking mechanism to hold the plurality of slips in the unset position; and an actuation system to unlock the locking mechanism, wherein the actuation system involves mechanisms of operation other than hydraulic fluid communication through the wall, such that the body is thereby free of hydraulic ports extending through the wall.

In accordance with another broad aspect, there is provided: a liner hanger assembly comprising the liner hanger above and a running tool configured to support the body.

In accordance with another broad aspect, there is provided: A method for setting a liner hanger in a well, the method comprising: running a liner hanger into the well; operating the actuation system to unlock the locking mechanism to thereby allow the plurality of slips to move into the set position; and setting the plurality of slips between the body and a wall of the wellbore; wherein the actuating involves mechanisms of operation other than hydraulic fluid communication through the wall, such that the body is thereby free of hydraulic ports extending through the wall.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all within the present invention. Furthermore, the various embodiments described may be combined, mutatis mutandis, with other embodiments described herein. Accordingly, the drawings and detailed description are to be regarded as illustrative in nature and not as restrictive.

BRIEF DESCRIPTION OF THE DRAWINGS

Referring to the drawings, several aspects of the present invention are illustrated by way of example, and not by way of limitation, in detail in the figures, wherein.

(a)

(b)

(c)

(d)

(e)

(f)

(g)

(h)

(i)

(j)

(k)

(l)

(m)

(n)

(o)

(p)

(q)

(r)

(s)

(t)

(u)

(v)

(w)

(x)

(y)

(z)

(aa)

DETAILED DESCRIPTION OF EMBODIMENTS

The detailed description set forth below in connection with the appended drawings is intended as a description of various embodiments of the present invention and is not intended to represent the only embodiments contemplated by the inventor. The detailed description includes specific details for the purpose of providing a comprehensive understanding of the present invention. However, it will be apparent to those skilled in the art that the present invention may be practiced without these specific details.

Because hydraulic components can degrade and become possible leak points through the liner hanger, it is advantageous to reduce the number of hydraulic penetrations through the liner hanger wall. To reduce leak points for example, a liner hanger has been invented without hydraulic penetrations such as hydraulic fluid ports that extend through the liner hanger body wall and elastomerically sealed interfaces that penetrate the liner hanger body wall.

Figure 1:
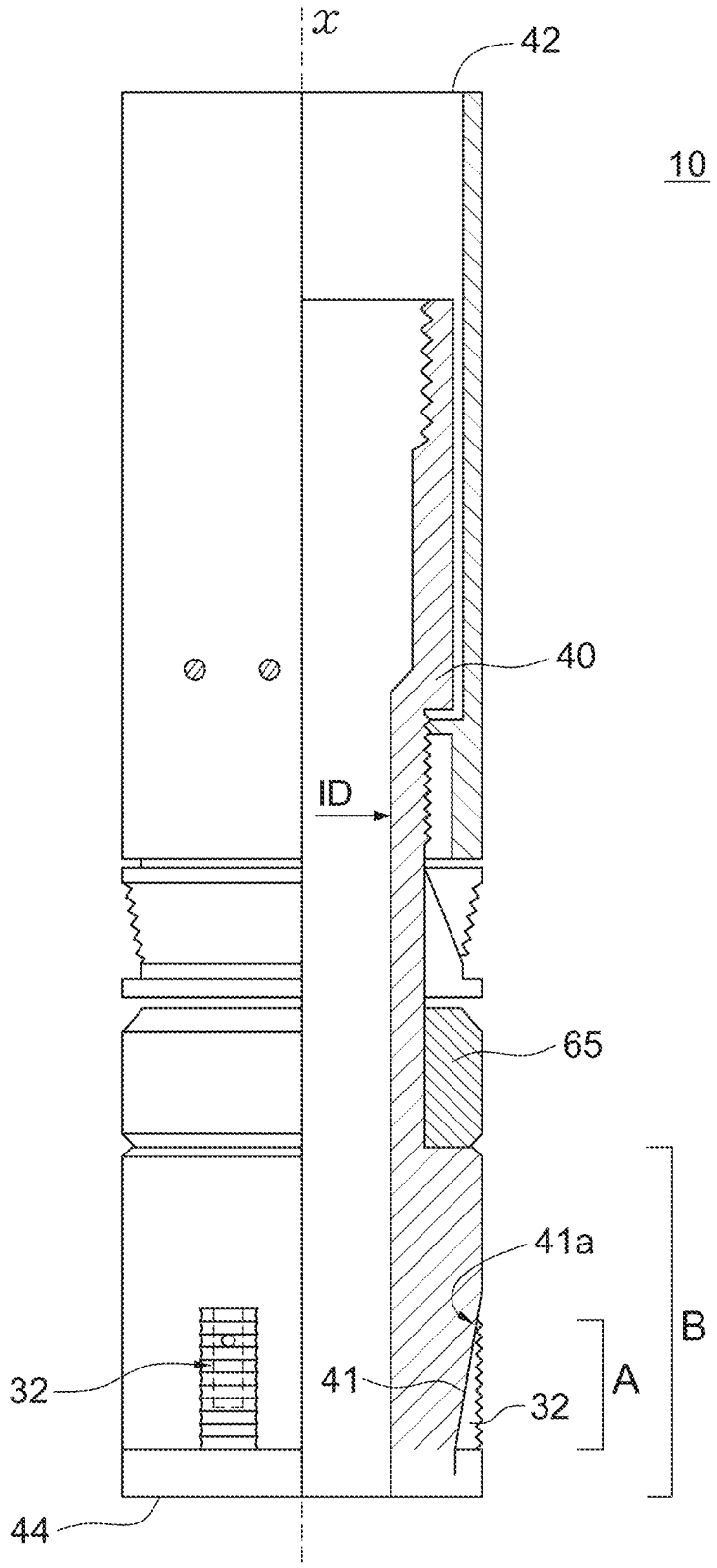
FIG. 1 is an elevation quarter-sectional view of a liner hanger according to one embodiment.

With reference to the figures, particularly FIG. 1, a liner hanger 10 has a body 40 with an open inner diameter ID, defining an axis x and an outer surface, between which is a body wall. The body may also be referred to as a mandrel. As will be appreciated, body 40 may have a cylindrical construction. The body has a body upper end 42 and a body lower end 44. Body 40 carries on its outer surface a plurality of setting slips 32, herein called lower, initial or setting slips, and an annular, packing seal element 65. Lower slips 32 are positioned axially offset, below the annular seal, for example between seal 65 and the tools lower end 44. Body 40 may have a tapered segment 41 on its outer surface with fully annular or partially annularly extending a frustoconical shape. Initial slips 32 are each disposed on the tapered segment and are configured to ride along the tapered segment toward its upper end 41*a* to be expandable outwardly.

Lower slips 32 are set initially to hold the liner hanger in place in a wellbore before annular seal 65 is set, expanded out, uphole of the slips 32 to complete the installation.

While in prior liner hangers, the lower slips are set by hydraulics, the present liner hanger 10 does not actuate the lower, initial slips by hydraulic means incorporated into the liner hanger. Instead, initially set, lower slips 32 on the liner hanger body are actuated to set by mechanical actuation or via signaling (i.e. via movement of the liner hanger body, magnets, electronically, radio signals). The mechanical actuation may be an external system or an internal system. Signaling can employ components on the liner hanger that are responsive to slight movements of the liner hanger body, magnetic and/or electronic signals from within the tool or from surface. Regardless, the liner hanger body 40 is devoid of openings, such as ports or interfaces with elastomeric seals, through the wall in the annular region laterally inwardly of the slips 32 (length A). For example, body 40, at the region A radially inwardly of slips 32, and possibly the entire length B of body 40 between seal 65 and lower end 44, is effectively solid by avoiding hydraulic systems that penetrate the body wall thickness. In summary, the slips are set without the use of hydraulic structures that penetrate the wall of body 40 below packing seal 65 and therefore, there is no leak path.

Also beneficial is that the liner hanger can be set via the setting slips 32 in the well, while the liner hanger remains generally static in the well. A running tool may be configured to assist with liner hanger operations and may hold the liner hanger static while applying forces to set the slips 32, set the packing seal 65 or apply torque.

External Mechanical Actuation for Setting Slips

Figure 2A:
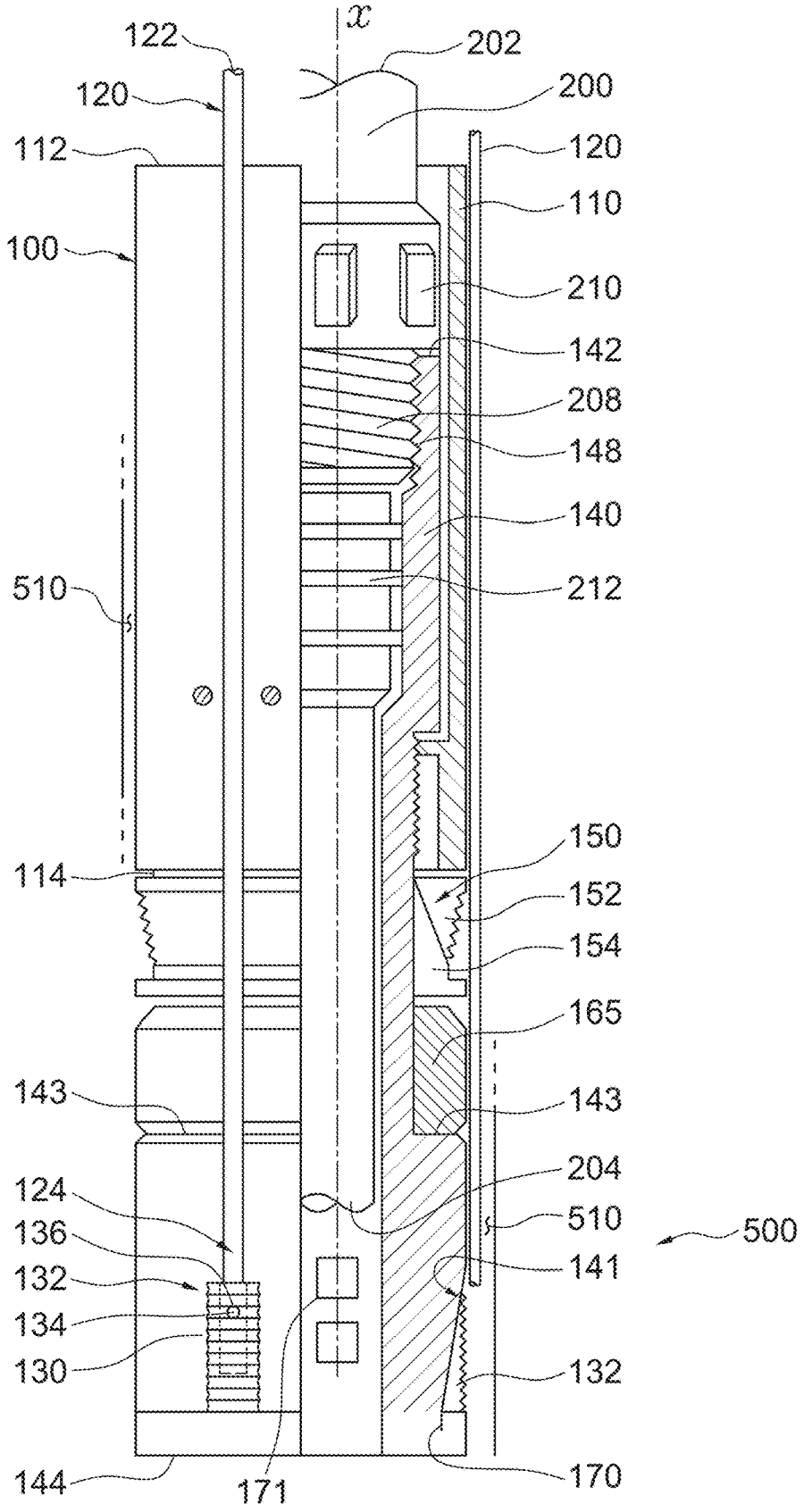
FIG. 2A is an elevation quarter-sectional view of a liner hanger according to one embodiment in a wellbore.
Figure 2B:
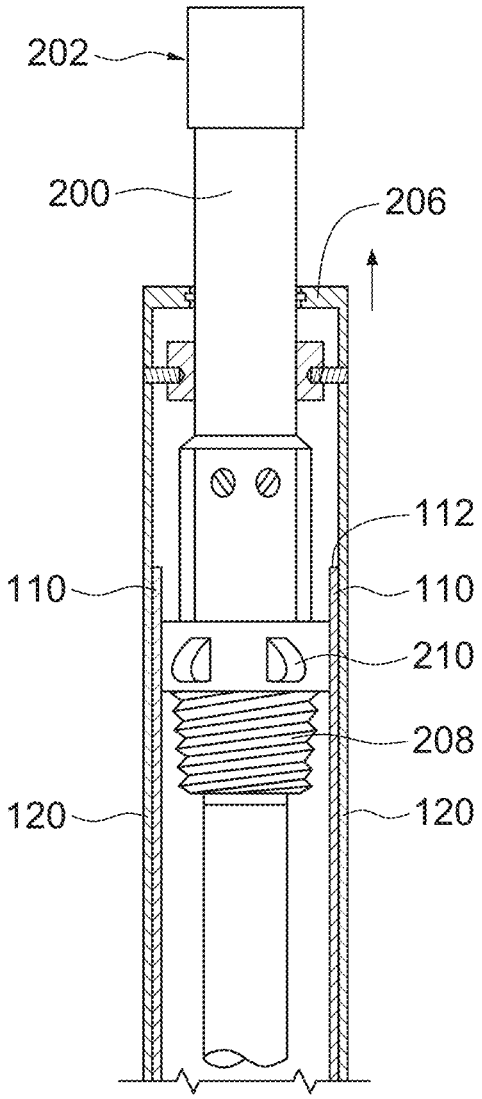
FIG. 2B is an elevation, partly cutaway view of a liner hanger according to one embodiment.

With reference to the figures, particularly FIGS. 2A and 2B, in one embodiment, initial, lower slips 132 are provided on the liner hanger that are actuated to set mechanically by a running tool 200. Running tool 200 may have an upper end 202 and a lower end 204. Upper end 202 may be defined by a top connection (see FIG. 2B). A body 140 of the liner hanger can be solid, for example, devoid of hydraulic ports, pistons and elastomeric seals for actuation of initial slips 132.

Initial slips 132 may be disposed on an outer surface of a body 140 of the liner hanger. While in the prior art initial setting slips are hydraulically actuated by means of a hydraulic port accessible from an inner diameter of the liner hanger body, in the instant embodiment, the initial setting slips 132 are actuatable via a tie rod 120 driven by running tool 200. Body 140 may have a tapered segment 141 with a frustoconical shape, with a shoulder transitioning from the regular outer diameter to the upper end of the tapered segment. Initial slip 132 may be disposed on the tapered segment. While there is a plurality of slips, for grammatical convenience, this description refers to a single slip. There may be one or more tie rods to actuate the slips. FIG. 2A shows an embodiment where there is a tie rod for each of the slips, but there may be fewer tie rods, for example, one tie rod that actuates all the slips, as described herein below at FIGS. 21-24.

Each tie rod 120 may be an elongate member extending along an exterior surface of body 140. The tie rod may extend parallel to axis x. The tie rod may extend from a rod upper end 122 to a rod lower end 124. Rod upper end 122 may be connected to the running tool, e.g., at a structure 206 driven by a hydraulic cylinder. Rod upper ends 122 may be mounted in grooves on structure 206 to reduce the outer diameter.

Figure 6:
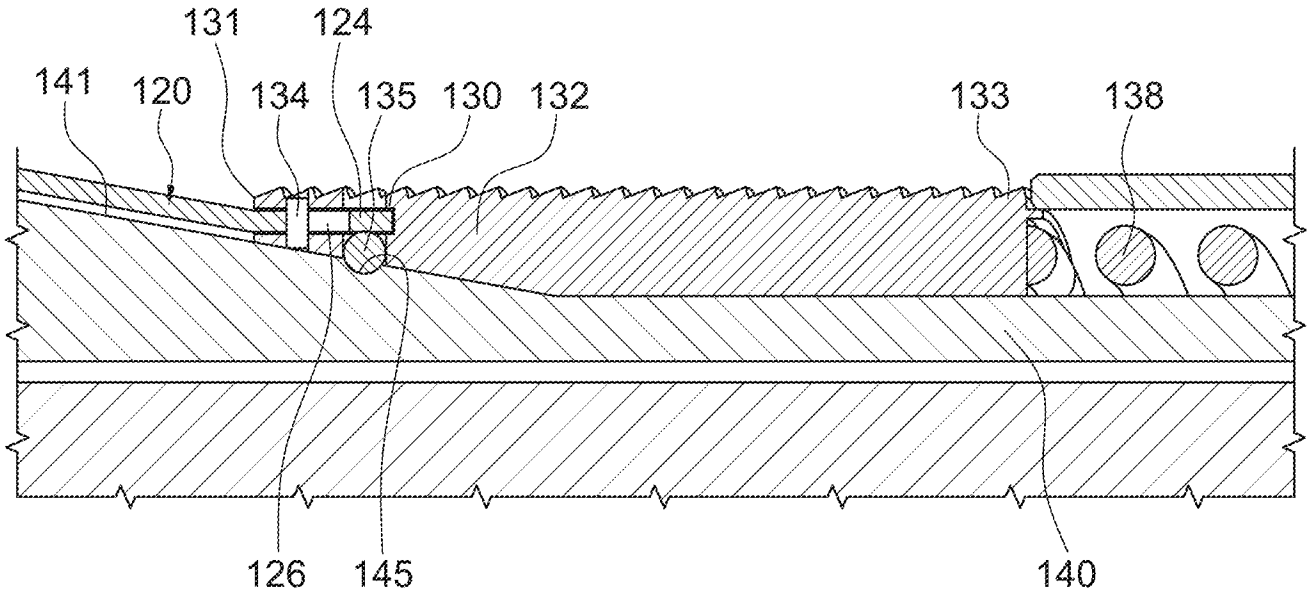
FIG. 6 is a cross sectional view of a slip according to one embodiment.
Figure 7:
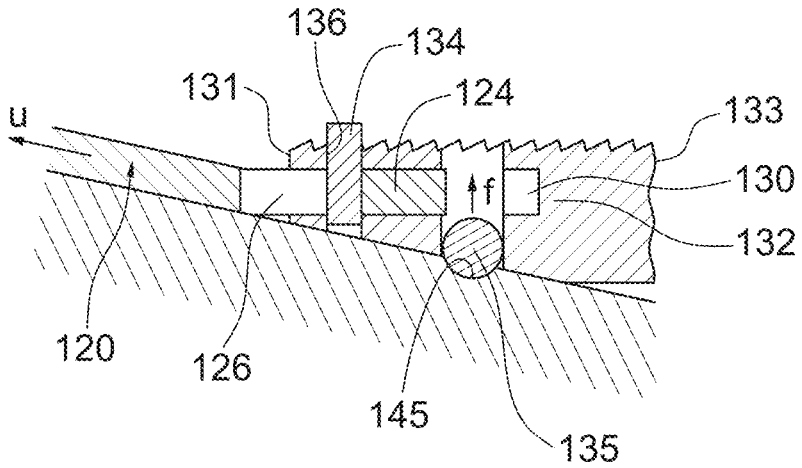
FIG. 7 is a cross sectional view of the slip of FIG. 6 freed to move out of its run in position.
Figure 8:
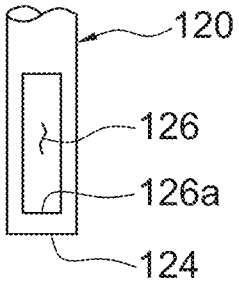
FIG. 8 is an elevation view of a bottom end of a tie rod according to one embodiment.

Each initial slip 132 may be disposed on body 140, e.g., proximate a lower end 144 of body 140, axially below shoulder 143 and element 165. With reference to FIGS. 6 to 8, initial slip 132 may have an axial bore 130 for receiving a portion of the tie rod's second end 124. The initial slip may be securable to the tie rod via a shear pin 134. The shear pin may be insertable into an aperture 136 of the initial slip and a slot 126 of the tie rod. The slot and the aperture may be positioned in alignment such that the shear pin can be inserted into both.

Figure 9:
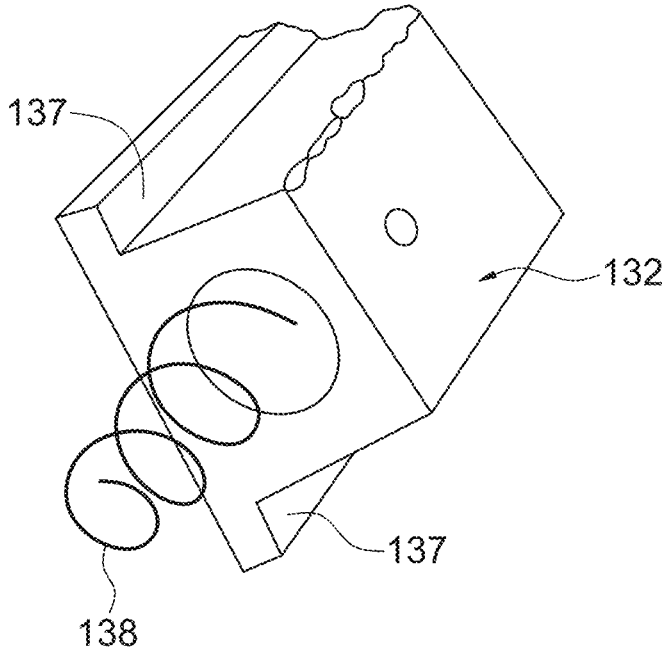
FIG. 9 is a perspective view of an initial slip according to one embodiment.

The slot 126 may have a length that permits limited movement (up to the length of the slot) of the rod parallel to axis x while the shear pin is disposed in the slot. With reference to FIG. 9, each initial slip may have a dovetail 137, which may be configured to fit within a track on frustoconical, tapered surface 141 to prevent rotational movement of the initial slip around axis x. The slips may be mounted on an outer surface of the body in tracks. The slips may be secured in the tracks by a dovetail, and in operation each slip may be intended to ride axially along its track when actuated to move.

The initial slip may have a thin end 131 and a thick end 133. In other words, the initial slip may be wedge shaped, such that it tapers from a thicker base to an upper tip. In use, the slips may interact with the frustoconical surface 141 such that when the slips move up in their tracks, they effectively increase the diameter of the assembly and can become wedged between the shoulder and a surrounding structure, such as casing 510.

The initial slip may be releasably couplable to the body 140 by a releasable lock. The releasable lock may take various forms. In one embodiment, the releasable lock includes an exterior recess 145 on the body, mateable with a ball 135. The ball may be locked in a hole through the slip when the ball is in the recess and the tie rod is pushed in to overlie the ball. When the tie rod is actuated to move the initial slip, the ball may become free, arrow f, to move up in the hole and out of engagement with the recess 145. This unlocks slip 132 from body and it can move axially upward and radially outward, fitting tightly between the body 140 and the casing 510.

In one embodiment, the initial slip may include a spring 138, which may be disposed against the thick base end of the given slip, to promote movement in a direction parallel to axis x, e.g., upward. The spring may be prevented from driving the slip, when the ball is held within the recess. In this aspect, the spring may be able to drive the slip when the tie rod is pulled up, arrow u, and the ball is released, arrow f, from the recess. The ball may be released when the tie rod begins to pull out of the slip. At that point, the tie rod may still be connected to the slip via the shear pin and may pull on the slips to move them upwards.

The tie rod may be actuatable to move the initial slip. In use, the tie rod may cooperate with the slip to secure the liner hanger in place, e.g., down hole in casing 510. The tie rod may be used to pull up on the slip to wedge the slip between the body and a surrounding structure of the environment, such as the casing. In particular, comparing FIG. 6 to FIG. 7, a method for securing the liner in place down hole may include pulling tie rod 120 up, arrow u, such that it pulls out from an overlying position over ball 135 and the ball can become freed from recess 145. The tie rod continues to pull out from the slip until the bottom 126*a* of slot 126 pulls on shear pin 134. At this point, tie rod 120 remains secured via pin 134 to the slip and can pull up on slip 132. This is facilitated by the driving action of spring 138. Slip 132 is pulled up via tie rod 120 until it fits tightly between an exterior surface of body 140 and casing 510. When the slips are jammed between the casing and the liner hanger body, the shear pins 134 may shear and the slips are free of tic rods.

Figure 10:
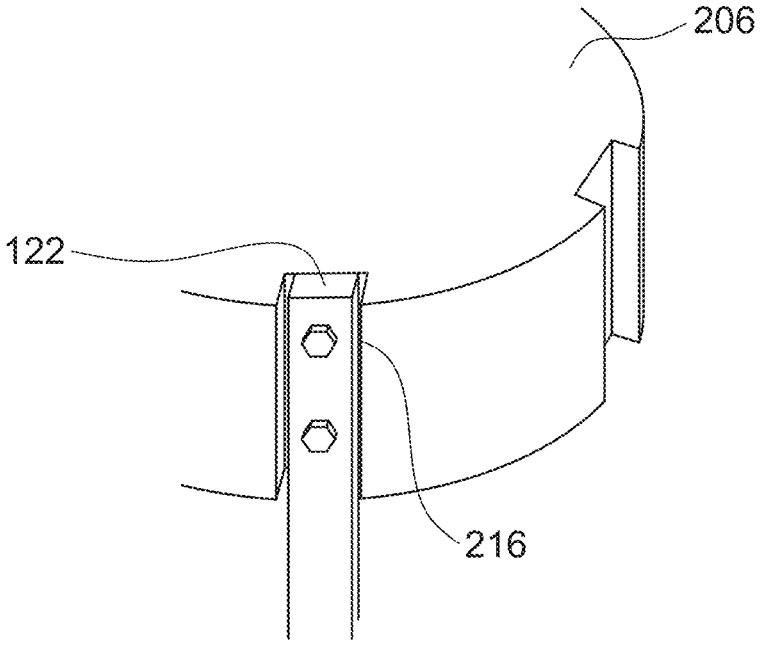
FIG. 10 is a perspective view of a tie rod coupled to a running tool according to one embodiment.

The running tool 200 may be used to drive the tie rods up, thereby driving the slips up. While the running tool is connected to the liner hanger body, as at a connections 148, 208 (as shown in FIG. 2A), the upper ends 122 of the tie rods are connected via coupling 216 to a hydraulic cylinder on the running tool (as shown in FIGS. 2B and 10). Driving the running tool to stroke the hydraulic cylinder pulls up on the tie rods and slips. The stroke is long enough to pull the slips up, as described above, into a position to carry the weight of the string. In one embodiment, the stroke is sufficient to thereafter pull the tie rods 120 up a distance to clear other radially expandable structures on the liner hanger, as will be described below.

Figure 3:
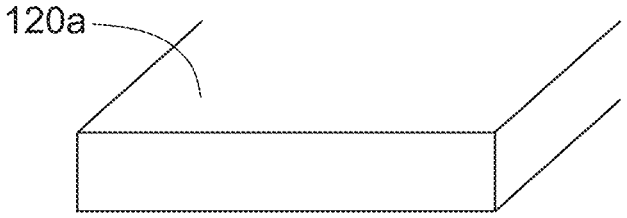
FIG. 3 is a perspective view of a tie rod according to one embodiment.
Figure 4:
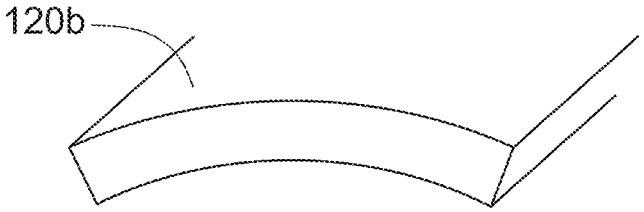
FIG. 4 is a perspective view of a tie rod according to one embodiment.
Figure 5:
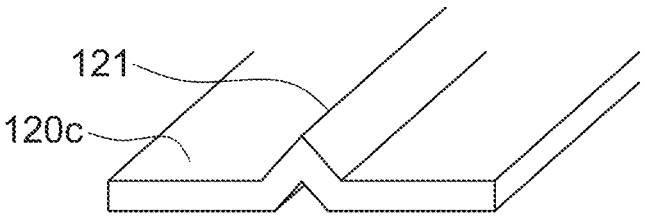
FIG. 5 is a perspective view of a tie rod according to one embodiment.

The tie rod may serve other purposes, such as to facilitate running in of the liner hanger into a casing 510 in a wellbore. For example, the tie rod may act as a skate and ride along an inner surface of casing 510. The tie rod then ensures that the liner hanger body is spaced from the casing wall and spares the liner hanger body from being damaged by dragging. With reference to FIGS. 3-5, the tie rod may have any number of configurations. In one embodiment, the tie rod has an elongate planar construction 120*a*, as illustrated in FIG. 3. In another embodiment, as illustrated in FIG. 4, the tie rod has an elongate curved construction 120*b*, which may be shaped such that an interior surface of the curved construction fits flush with an exterior surface of the setting sleeve, and possibly also an exterior surface of body 140, e.g., below step 143. In one embodiment, as illustrated in FIG. 5, the tie rod may have a rolled shaped construction 120*c*, including a ridge 121 extending along a long axis of the tie rod. In another embodiment, the tie rod may be cylindrical. In one embodiment, the tie rod may be made of a non-metal material, such as a composite material.

Tie rods and initial slips may be arranged circumferentially around the liner hanger. Each tie rod and initial slip assembly may be axially aligned, and, optionally, distributed substantially circumferentially equidistant from one another.

As noted above, an embodiment may include a tie rod for each slip or fewer tie rods than the number of slips. For example, with reference to FIGS. 21-24, an embodiment with a single tic rod 220 is shown.

Figure 22A:
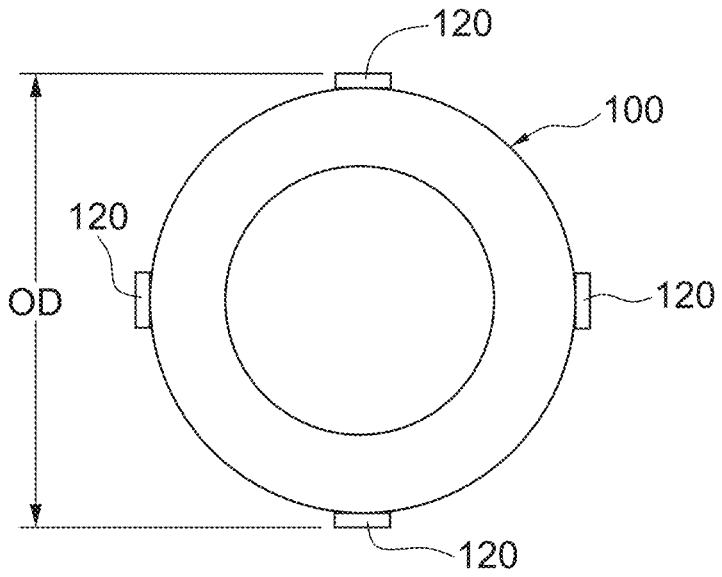
FIG. 22A is an orthogonal section showing a liner hanger with multiple tie rods.
Figure 22B:
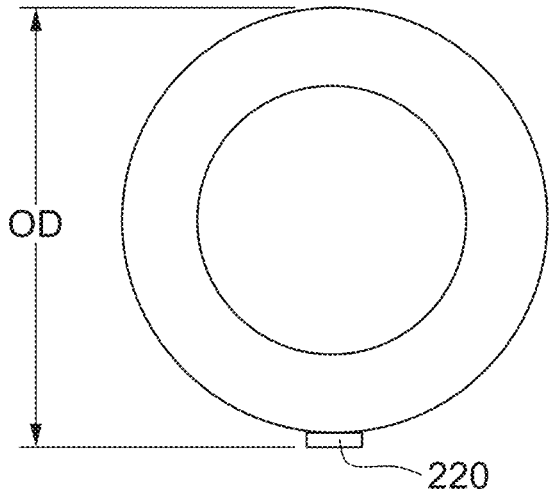
FIG. 22B is an orthogonal section showing a liner hanger with a single tie rod.

There are advantages to having a tie rod for each slip, such as illustrated in FIG. 2A, since each slip is directly actuated and the body is spaced by the tic rods away from the casing. However, the impact of multiple tie rods 120 on outer diameters may be considered. Embodiments with multiple tie rods, generally will have a larger outer diameter OD (FIG. 22A) over an embodiment with fewer tie rods (FIG. 22B). A liner hanger with a larger outer diameter is more challenging to run into the wellbore. A single tie rod adds a structural thickness and adds to the outer diameter on only one side.

Figure 23:
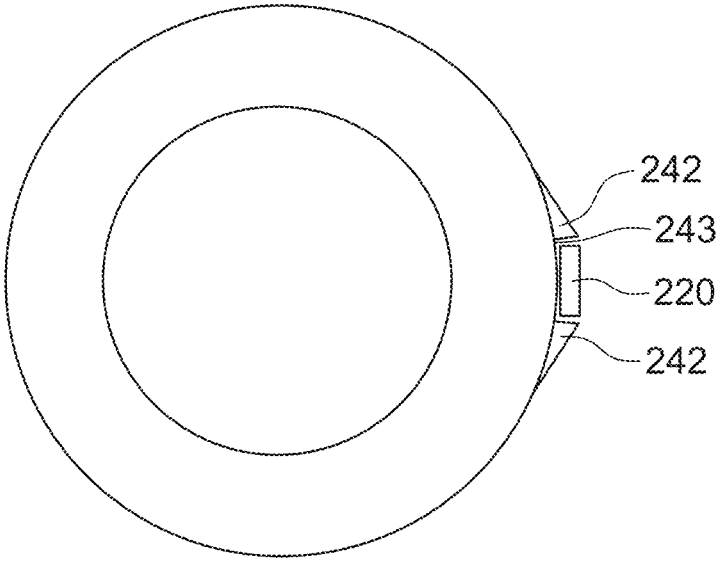
FIG. 23 is an orthogonal section showing a liner hanger with protectors for a tie rod.
Figure 24:
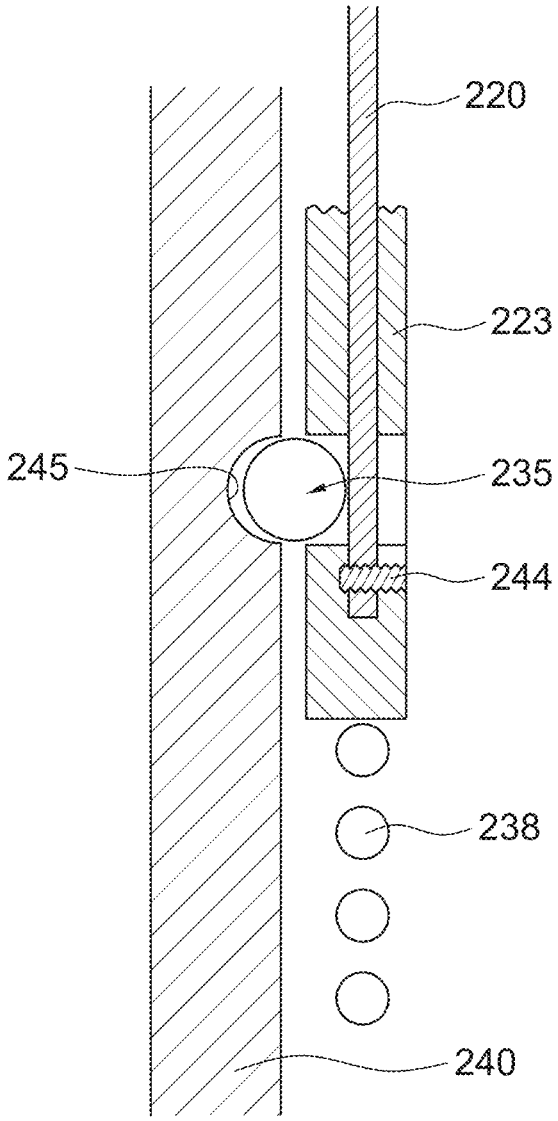
FIG. 24 is a slip setting assembly useful in an embodiment with a slip carrier; and (bb)

As shown in FIG. 23, ramps 242 can be added, built up on the outer surface of the liner hanger body to create a groove 243 in which the tie rod resides. The ramps 242 protect tie rod 220 during run in and facilitate rotation of the liner hanger. The ramps can be used for embodiments with multiple tie rods (FIG. 2A), or embodiments where there are fewer tie rods than slips, as shown. It can be appreciated however, that where there a multiple tie rods, the ramps permanently increase the OD, even after the tie rods are removed.

Where there are fewer tie rods than the number of slips, there may be a slip carrier 223. Slip carrier 223 may be an annular member and slips 232 may be installed extending upwardly from the slip carrier, as by use of arms 232*a*. The slips are spaced apart around the slip carrier. Lower end 224 of tie rod 220 is coupled to slip carrier 223. There may be a driver 238, such as a spring or a piston/atmospheric chamber, to apply an extra force against the slip carrier. Where there are fewer tie rods than the number of slips, tie rod 220 can activate the slip carrier in one of a number of ways, for example:

(a) Tie rod 220 can apply a direct pull force on slip carrier 223 to pull slips 232 up;

(b) Tie rod 220 can operate a valve to open and flood an atmospheric chamber that provides the energy to moves the slip carrier, and thereby the slips, up into the set position; or (c) Tie rod 220 can operate a release mechanism, such as one shown in FIG. 24. The release mechanism can include, for example, a lock or anti-preset function for the slip carrier. Release mechanism may include a shear screw 244 connecting between tie rod 220 and slip carrier 223 and a ball 235 and groove retainer/release 245 (similar to that of FIG. 6) on body 240. A pull force on the tie rod, shears screw 244 and moves the tie rod to release the ball 235 from the groove 245. Operation of the release mechanism allows the driver, such as a spring to move slip carrier 223, and thereby slips 232, up.

In one embodiment, the slip carrier can form a lower end of the liner hanger and a crossover 239 can be coupled to a liner 260 below.

In operation, an assembly including the running tool 200 and the liner hanger 100 is lowered into the casing. This may be facilitated via the one or more tie rods 120, 220 skating along the casing, reducing surface area of contact of the assembly, particularly the liner hanger, with the casing 510, thereby protecting the components of the assembly. When the assembly is lowered to the desired position in the casing, the one or more tie rods 120, 220 may be actuated (e.g., pulled up). Initial upward movement in in the tie rod releases the releasable lock, for example preset ball 135, 235 between the slips 132, 232 and the liner hanger body 140, 240. Further upward travel of the tie rod forces the initial slips axially upward and radially outward, thereby setting the initial slips into a tight fit between the casing and the body. The tie rods may be pulled further axially upward, thereby breaking the shear pins connecting the tie rod to its initial setting slip or the slip carrier, permitting the tie rod to be pulled up out of the way of the other components on the liner hanger. Eventually, the tie rods are pulled with the running tool out of the casing.

As will be appreciated, the use of the one or more tie rods for setting the slips can be conducted while the liner hanger remains static in the well bore. Only the components of the tic rods and the running tool structure 206 need be moved, while the body 140, 240 does not need to be moved axially or rotationally. Further, no hydraulic port is required to extend through the wall of the liner hanger body and therefore, the formation of a possible leak path is avoided.

Internal Actuation for Setting Slips

With reference to FIGS. 16 to 20, another liner hanger slip activation system is shown. As with the above-noted embodiments, initial, lower setting slips 432 are provided on an outer surface of a body 440 of the liner hanger. Body 440 has a tapered segment with a frustoconical shape (not shown, but similar to surface 141 of FIG. 2A) over which the slips 432 are installed to move. As noted above, the plurality of slips 432 are actuable to move from an unset position adjacent the smaller diameter, tapered end of the tapered segment to a set position on the larger diameter portion of the tapered segment of the body. This effectively increases an outer diameter of the liner hanger and jams the slips between body 440 and the casing wall.

In this embodiment, slips 432 are actuated to move from the unset to the set position by a slight movement of the liner hanger body that signals the setting process. The slight movement is via mechanical expansion of the liner hanger body. In particular, liner hanger body 440 has a solid wall, but has a smaller diameter region 455 along its length that is in actuating communication with the slips 432. Smaller diameter region 455 is exposed in the bore of the liner hanger body. While the liner hanger body has a normal diameter D1 across the bore along most of its length, the smaller diameter region 455 has a diameter D2 that is less than D1. The smaller diameter region has an upper shoulder 455*a* where D1 constricts in to D2 and a radially stepped out lower shoulder 455*b*, where the diameter D2 expands out to D1. The actuation of slips 432 to set is caused by expanding out smaller diameter region 455, arrows E, such that its diameter expands from D2 to a dimension closer to D1. The expansion is by applying force against the inner wall to push the body wall out. This expansion occurs when the liner hanger is in the wellbore, where it is intended to be installed. A setting tool can be employed that applies the force, arrows E, from within the liner hanger body.

The liner hanger body can be constructed of typical materials, such as oilfield steel. The smaller diameter region is worked into the material during manufacture and uses the steel's mechanical properties between when it begins to yield and when it fails. The final strength of the mandrel, after expansion, is about the same as the non-constricted portions with diameter D1, as the wall thickness is substantially unchanged and the expanded portion may have a higher strength as it has been "work hardened".

Actuation of slips 432 by body expansion can be by various mechanisms. For example, mechanically expanding body 440 can free the setting slips from a retainer, can open a pressure port external to body or can displace a component axially.

Figure 16:
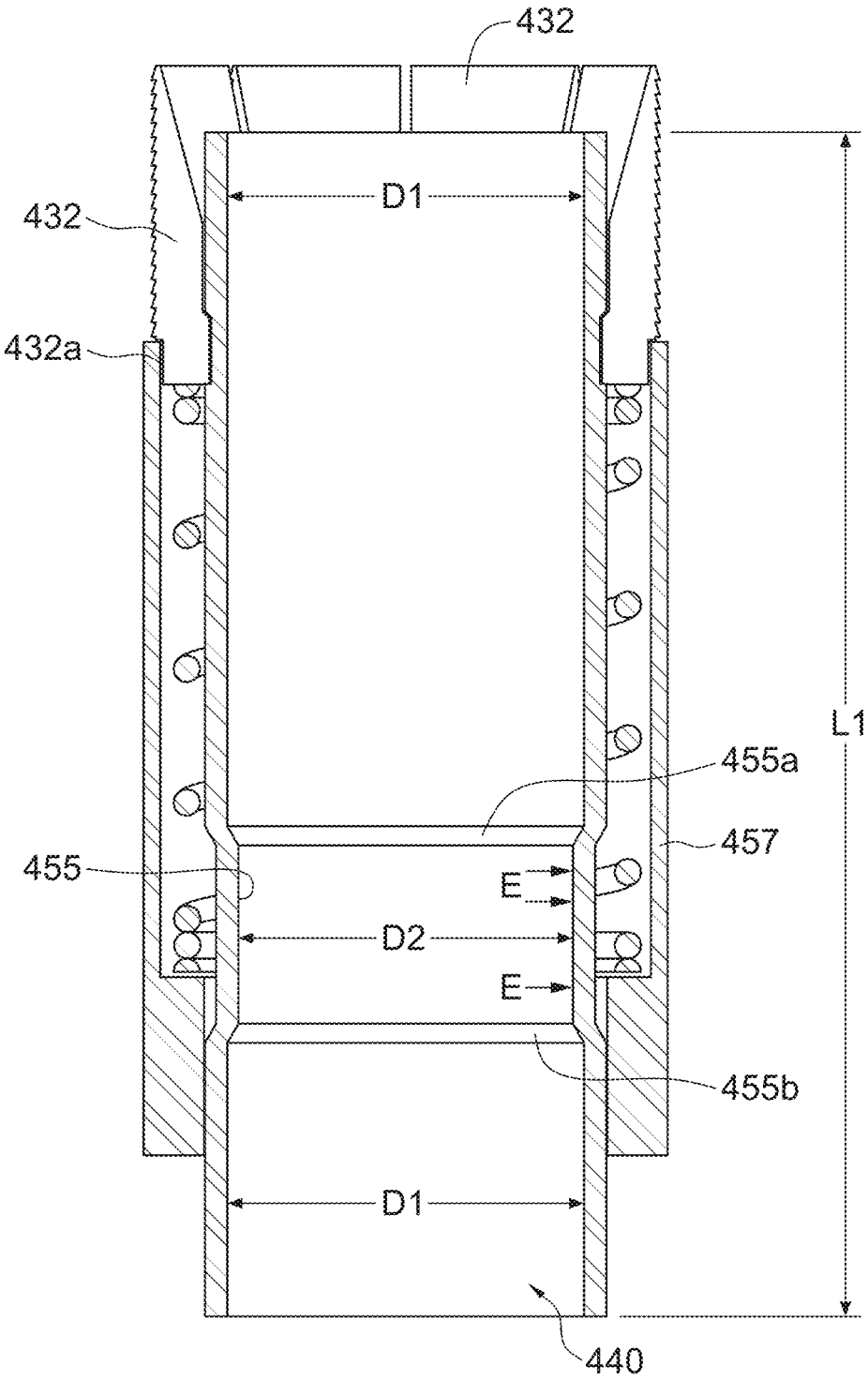
FIG. 16 is a cross section through a liner hanger, in the running position, with an expandable mandrel for actuating the setting slips.
Figure 17:
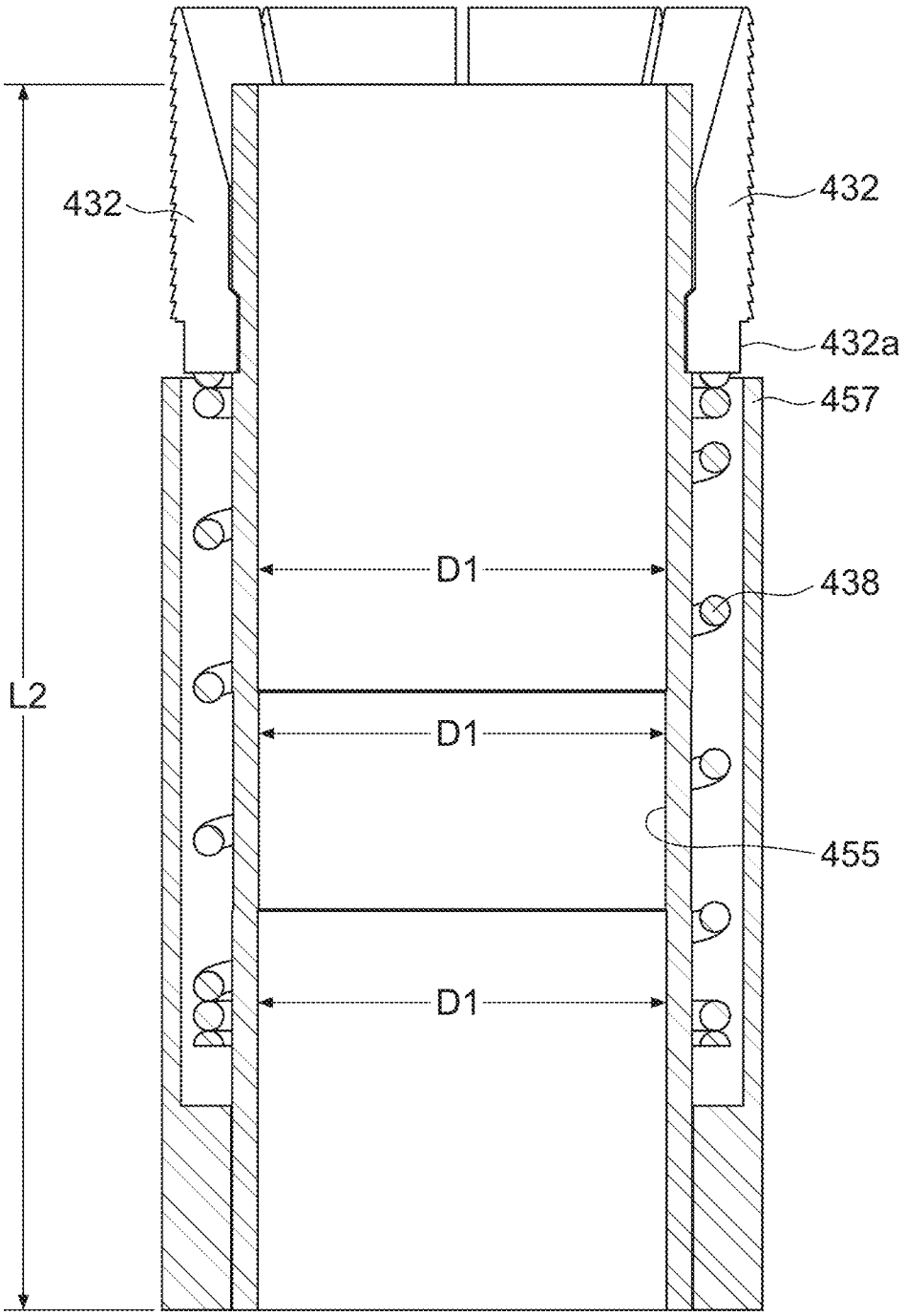
FIG. 17 is the liner hanger of FIG. 16 after expanding the mandrel and thereby setting the slips.

In one embodiment shown in FIGS. 16 and 17, the expansion of smaller diameter region 455, arrows E, to a dimension closer to D1 causes a lengthening of body 440 that moves slips 432 axially to drive them along the tapered segment actuate them. In other words, the axial length of the body 440 can be increased from L1 to L2 by expanding the diameter of the body at region 455 and this increase in length is captured to actuate the slips.

In the illustrated embodiment, for example, the liner hanger setting slips 432 are coupled to and move with liner hanger body 440. The liner hanger includes a housing 457 that substantially surrounds the liner hanger body and is connected at an opposite end of the liner hanger from the slips. The smaller diameter region 455 is in the span between where the housing 457 is connected to the liner hanger body and where the slips are coupled to body 440.

During run in, slips 432 are retained in a retracted position by housing 457. Housing 457 substantially surrounds the liner hanger body and has an end that overlaps the slips at 432*a*. While radial expansion of liner hanger body 440 lengthens it, housing 457 is not lengthened. Therefore, when smaller diameter region 455 is expanded to a dimension closer to D1, the resultant lengthening of body 440 moves slips 432 axially out from under the housing (FIG. 17) such that they can move along their frustoconical surface (not shown) to expand into the set position. The length change caused by expansion is selected to be more than the axial length of overlap of housing 457 over the slips 432.

The liner hanger may include a driver 438 such as a spring or pressure chamber to move the slips against their frustoconical expanding surfaces to set. The driver may be in the space between the liner hanger body and the housing to act against the slips.

Figure 18:
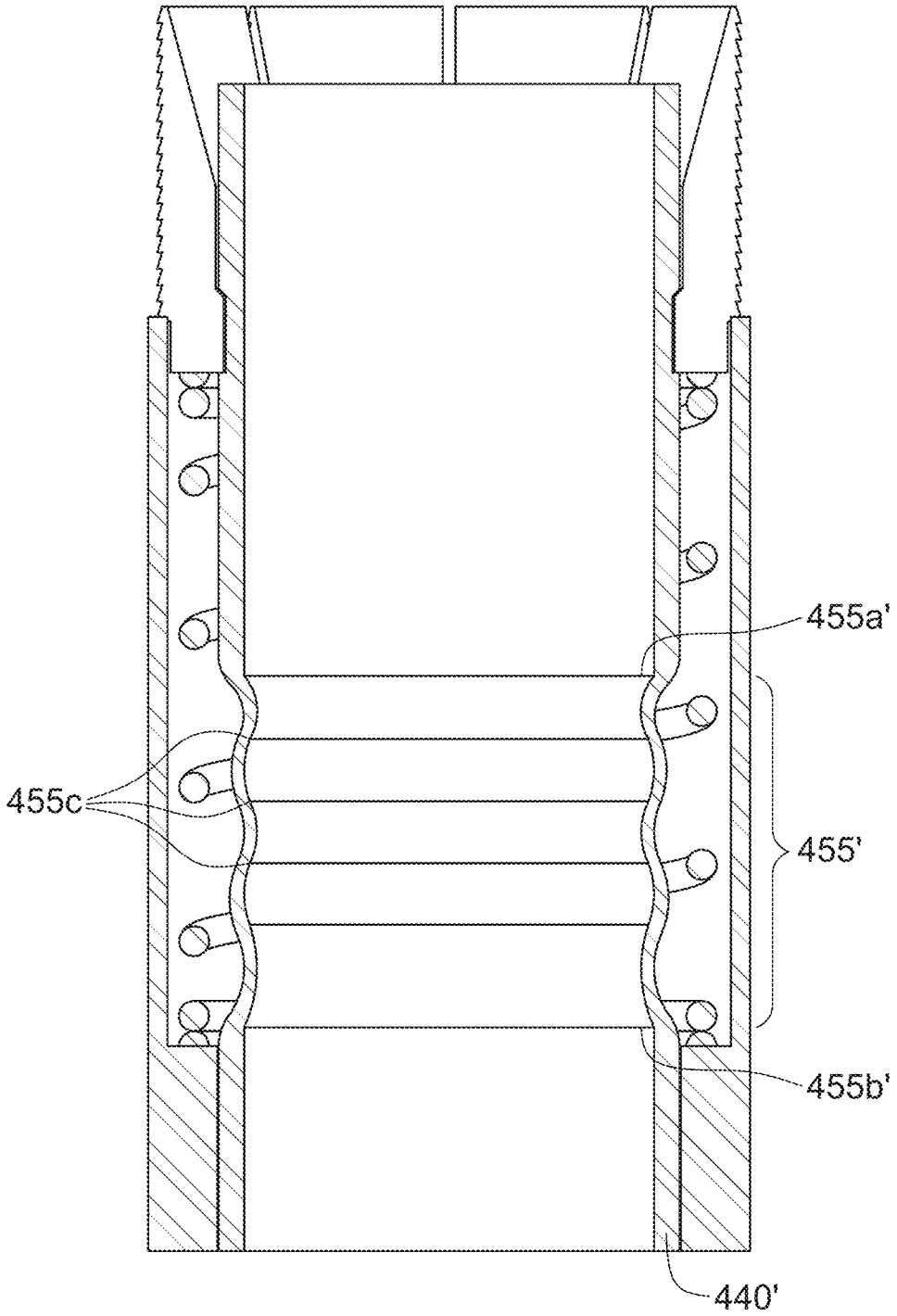
FIG. 18 is a cross section through a liner hanger, in the running position, with an expandable mandrel for actuating the setting slips.

The length change is associated with the dimensions of steps 455*a*, 455*b*, as they are straightened out by expansion. If it is desired to increase the degree to which body 440 lengthens, the shoulders can be increased in diameter change size or the number of shoulders can be increased. Therefore, as shown in FIG. 18, in the situation where an additional length change is desired, smaller diameter region 455' can be configured with more than two diameter changes. Small diameter region 455' may, for example, be configured as a wave structure with an upper shoulder 455*a*', a lower shoulder 455*b*' and a number of additional shoulders 455*c* in between the upper shoulder and the lower shoulder where the diameter is stepped in or out. This multiplies the length change of body 440' by the number of waves.

Figure 19:
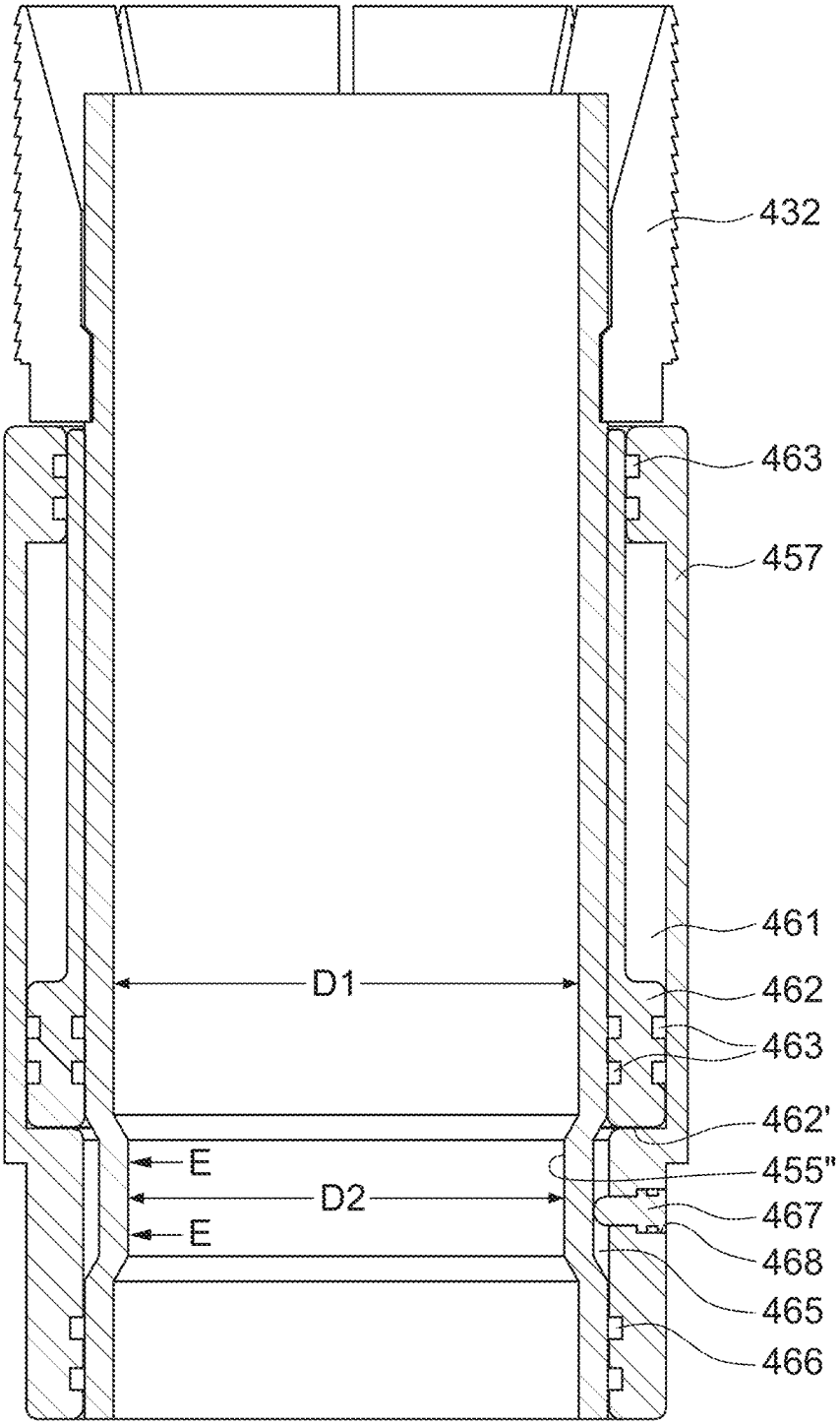
FIG. 19 is a cross section through a liner hanger, in the running position, with an expandable mandrel for actuating the setting slips.
Figure 20:
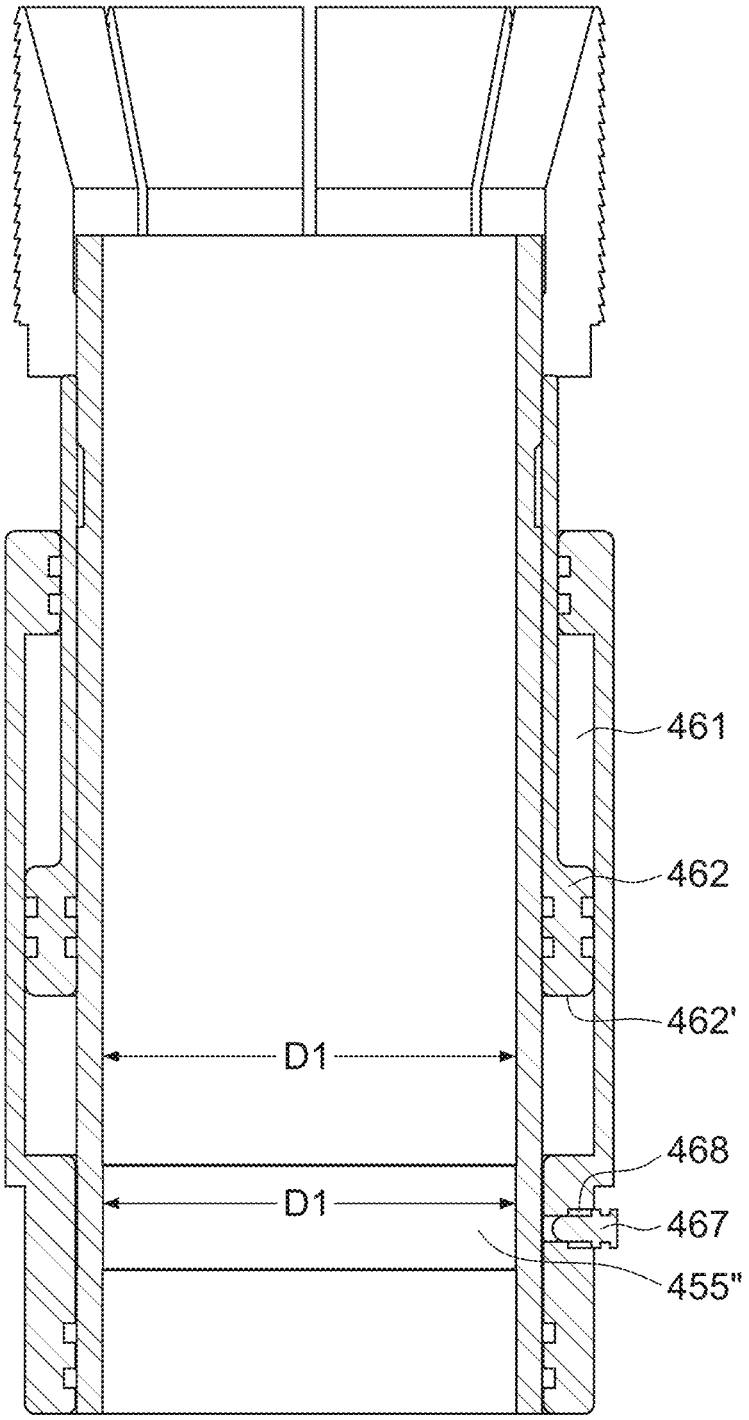
FIG. 20 is the liner hanger of FIG. 19 after expanding the mandrel and thereby setting the slips.
Figure 21:
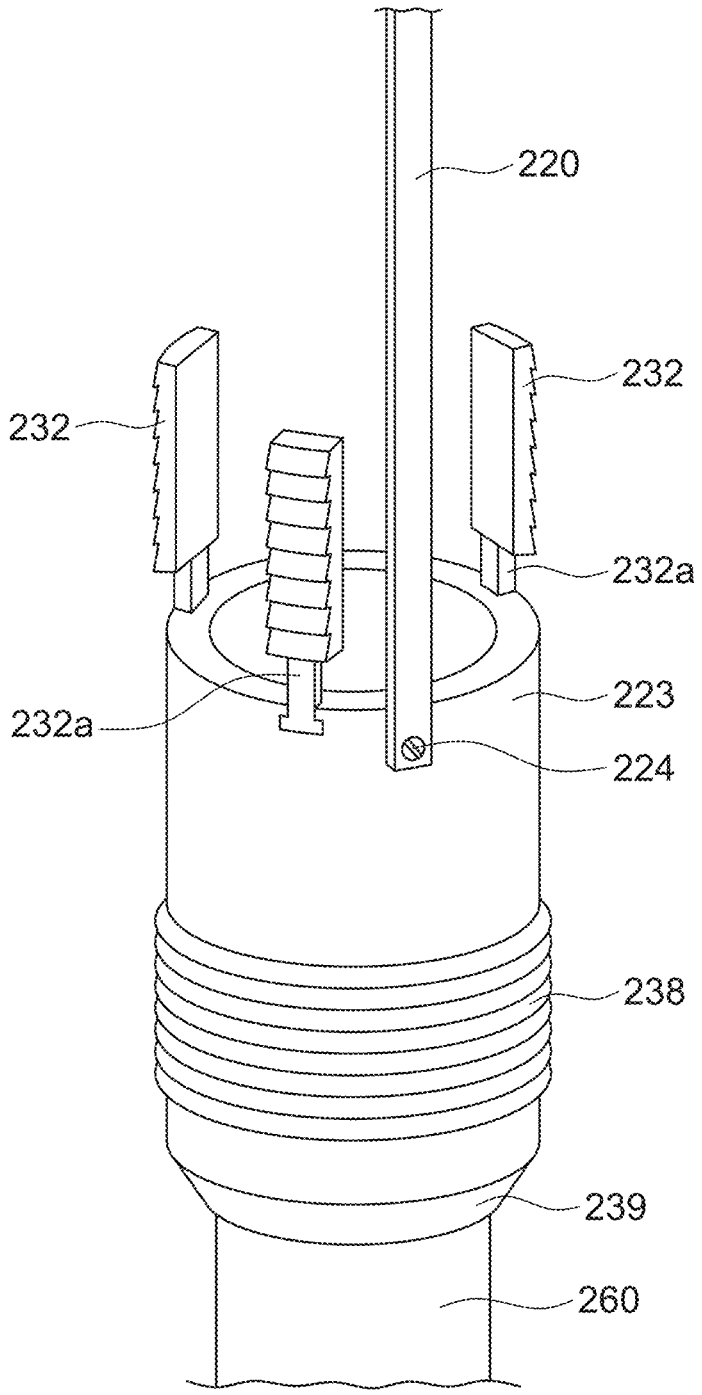
FIG. 21 is a slip setting assembly useful in an embodiment with fewer tie rods than setting slips.

FIGS. 19 and 20 show another mechanism for actuation of slips 432 by the diametric expansion of body 440. In this embodiment, the expansion of smaller diameter region 455", as by arrows E, to a dimension closer to D1 causes an outer surface of body 440 to affect an atmospheric chamber 461, that in turn drives a piston 462 against slips 432 to axially move and actuate them.

In the illustrated embodiment, for example, the liner hanger setting slips 432 are normally coupled to liner hanger body 440, but can be moved axially along body 440 and onto the frustoconical expansion surface (not shown) by application of force to the slips. The liner hanger includes a housing 457 that substantially surrounds the liner hanger body with an annular space between them, which accommodates the atmospheric chamber 461. Piston 462 is configured to be movable axially within the annular space, in response to pressure differentials affecting chamber 461. Seals 463 on and around piston 462 seal the atmospheric pressure within chamber 461. Another chamber 465 is in fluid communication with a piston face 462' of piston 462 and is sealed by seals 466 and a plug 467.

Plug 467 normally creates a fluid tight seal in a port 468 from an outer surface of the liner hanger to chamber 465. However, plug 467 is openable as by breaking or moving to open port 468. In one embodiment, plug 467 is a poppet value with its actuating head within chamber 465.

Plug 467 is positioned laterally outwardly of smaller diameter region 455" and is spaced close or against the outer diameter of body 440 at smaller diameter region 455".

During run in (FIG. 19), slips 432 are retained in a retracted position by breakable connections, a band or other retaining structure. When liner hanger is in a desired position in the well, smaller diameter region 455" is expanded, as for example by swaging, with a running tool to from its smaller diameter D2 to a dimension closer to D1. When smaller diameter region 455" is expanded out, the outer diameter of the body at region 455" contacts plug 467 and opens the port 468. Once opened, wellbore fluid, which is at a pressure higher than that of fluid within atmospheric chamber 461, passes through port 468 and acts against piston face 462', which actuates piston 462 to move axially. The pressure differential causes atmospheric chamber 461 to collapse, which moves the piston with force axially away from port 468 and towards and against slips 432. Slips 432 are moved axially (FIG. 20) along their frustoconical expanding surfaces (FIG. 20).

For any of these embodiments, the smaller diameter region 455, 455', 455" need only be expanded out to about the normal diameter D1. There is no need to expand the body beyond D1, which ensures the liner body is not over deformed and weakened.

The diameter expansion for setting the slips can be conducted while the liner hanger remains static in the well bore and no hydraulic port is required to extend through the wall of the liner hanger body.

Signaling Actuation for Setting Slips

Figure 12:
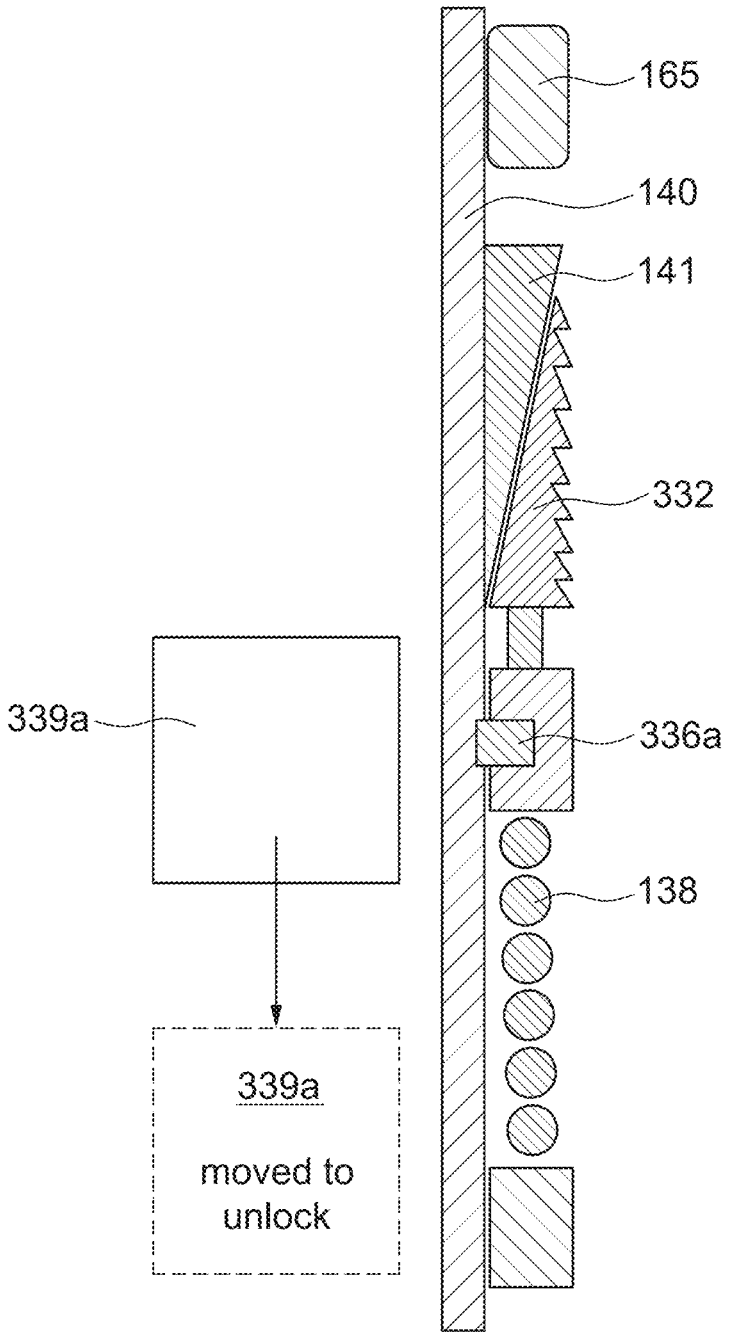
FIG. 12 is a cross section of another slip according to one embodiment.

With reference to FIG. 12, another slip configuration is illustrated. In particular, in another embodiment, initial, lower slips 332 are provided on the liner hanger that are actuated to set mechanically by a signal sent a signal generator such as from within the liner hanger body to a locking system that locks the slips in place. As with the earlier embodiment, initial slips 332 may be disposed on an outer surface of a body 140 of the liner hanger. Body 140 may have a tapered segment 141 with a frustoconical shape. The initial slips 332 may be disposed adjacent the tapered end of the tapered segment. The plurality of slips 332 are actuatable to move from an unset position adjacent the tapered end of the tapered segment to a set position on a larger diameter portion of the tapered segment of the body, to increase a diameter of the apparatus. In this embodiment, a locking mechanism 336*a* holds the plurality of slips in the unset position. The locking mechanism may be a connection, such as a latch, a pin, an intermediate layer, etc. between the slip and the liner hanger body. The locking mechanism is responsive to a signal from an actuation system 339*a* to unlock the locking mechanism. The actuation system, which generates the signal, in or around the well, such as at surface or within the liner hanger, for example mounted in the liner hanger body or situated in running tool 200. The actuation system works together with the locking mechanism 336*a*. For example, a radio signal responsive locking mechanism 336*a* and a radio signal generator 339*a*. The locking mechanism may be a pin, ring, etc. that engages both a shoulder on the body and a shoulder on the slip rear surface.

In FIG. 12, radio signal generator 339*a* is moved through the liner inner bore past the locking mechanism to unlock it.

In another embodiment, a magnetorheological material, which is commonly called a magnetorheological fluid (MRfluid), may be used to construct the locking mechanism. MRfluid is a solid while in a magnetic field and liquefies when the magnetic field is removed. As such, the pin could be constructed of a MRfluid and the signal generator could be a magnet. Once the magnetorheological material locking mechanism liquefies, the slip is free to move.

Figure 13A:
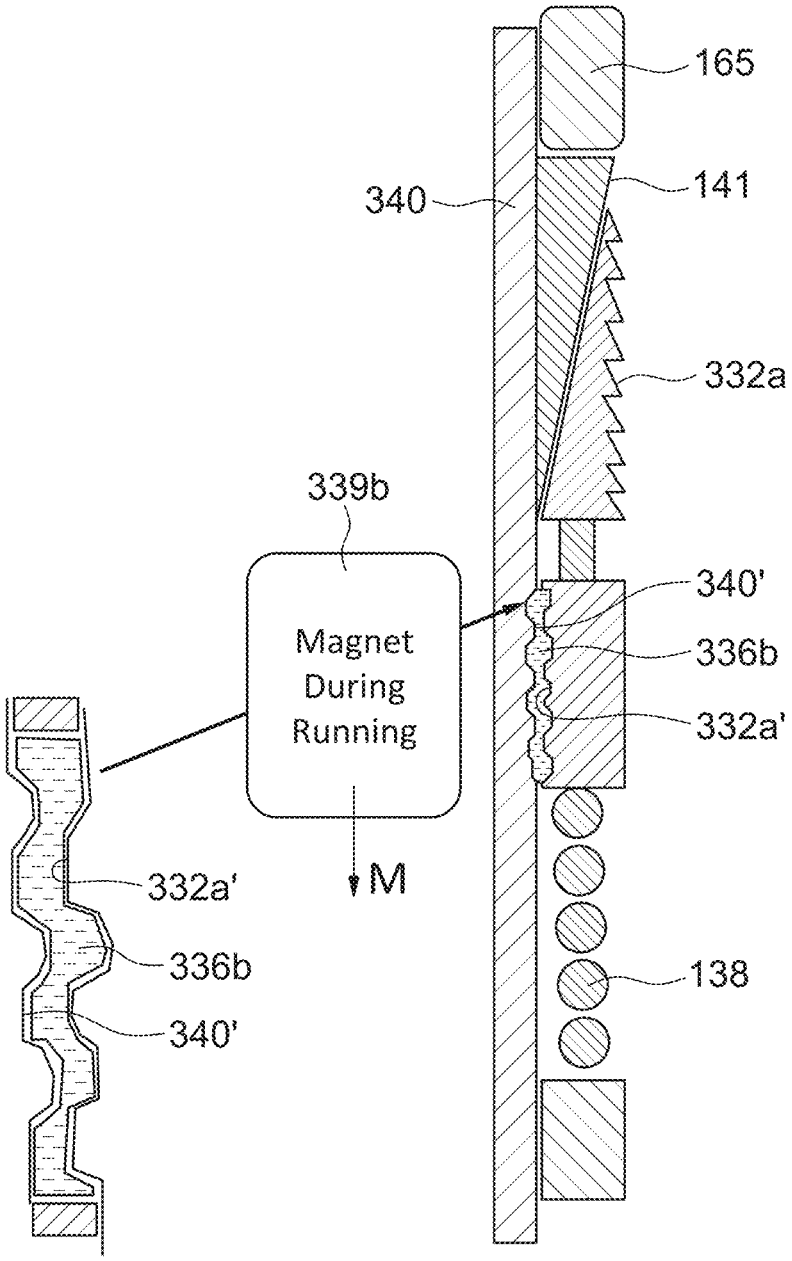
FIG. 13A is a cross section of another slip locked in an unset position.
Figure 13B:
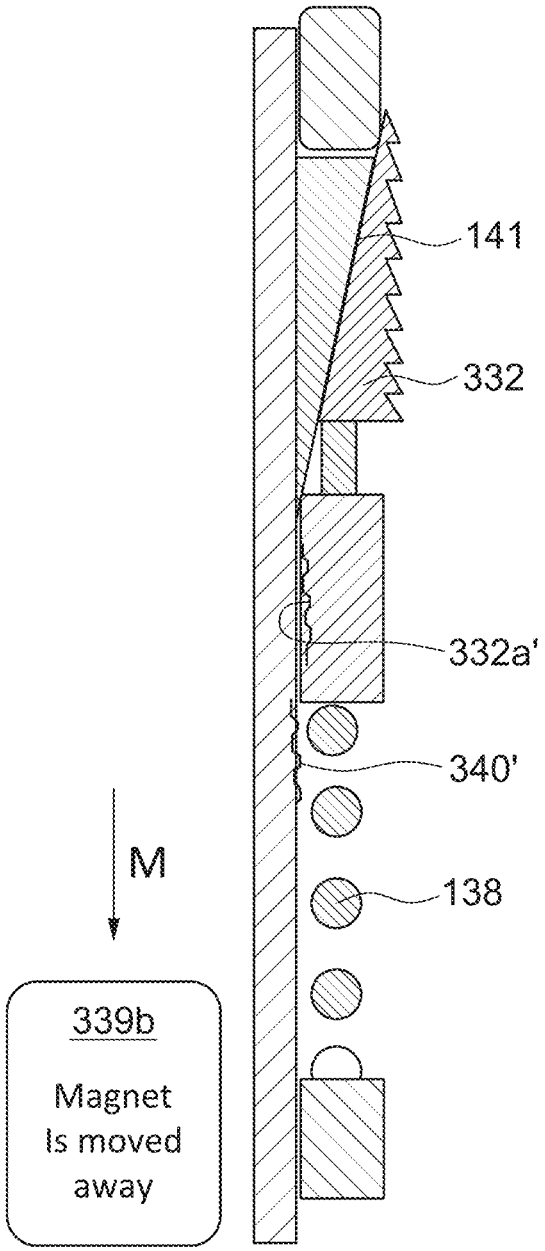
FIG. 13B is a cross section of the slip unlocked and moved to the set position.

In another embodiment, as shown in FIGS. 13A and 13B, the magnetorheological material 336*b* may effectively form an adhesive between an outer surface 340' of the liner hanger mandrel 340 and a surface 332*a'* on the rear of slip 332*a* or its retainer. When the MRfluid is solid, it holds the slip in place on the liner hanger outer surface (FIG. 13A). A magnet 339*b* is positioned adjacent the material 336*b* and when it is moved, arrows M, the MRfluid liquefies. When the MRfluid liquefies (FIG. 13B), the slip can move into a set position along the conical setting surface 141. Treating the surfaces to be non-smooth, for example irregular, grooved, roughened or faceted, enhances the engagement between the MRfluid and the surfaces.

Other actuation systems may, for example, include:

(a) a radio frequency identification (RFID) technology, where a RFID emitter is used as the actuation system to unlock an electrical cell in the locking mechanism. The electrical cell may be battery powered to sense the RFID signal and act on it. The electrical cell keeps the two parts locked together in place as long as the RFID is near, but once it is removed, the two parts unlock;

(b) battery operated locking mechanism; or (c) a timer to release the locking mechanism at a pre-set time.

A driver 138 is also provided for the plurality of slips to drive them from the unset position to the set position, when the locking mechanism is unlocked. The driver may be a biasing member such as a spring, as shown, a push cylinder, etc.

Figure 14:
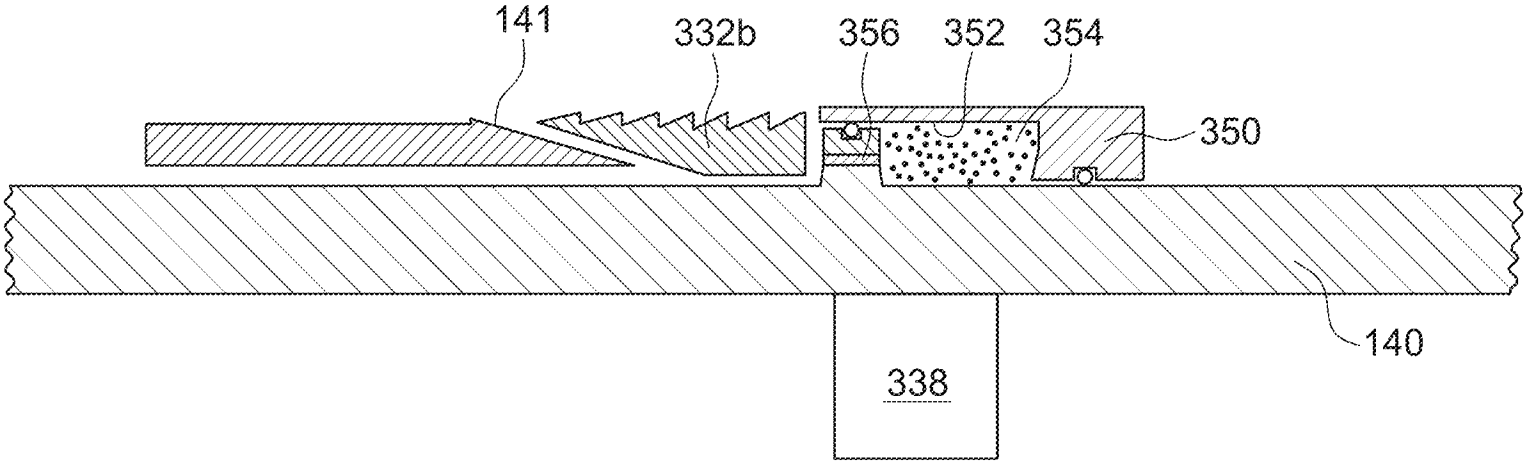
FIG. 14 is a cross section of another slip according to one embodiment.

With reference to FIG. 14, another embodiment is shown that uses both the mechanical and hydraulic properties of a magnetorheological material in combination. For example, a slip setting mechanism may include a piston 350 for pushing the slips 332*b*. Piston 350 has an atmospheric chamber 352 filled with MRfluid 354. This is used as both the locking mechanism and the driver force for the slips. When magnet 339 is moved to eliminate the magnetic field's effect on the MRfluid 354, the MRfluid blocking an exit port 356 from chamber 352 and the MRfluid in the atmospheric chamber liquefy and can flow out of the atmospheric chamber, as the wellbore pressure compresses the atmospheric chamber volume.

This drives piston against slips 332*b* and slips are driven along the frustoconical tracks 141 to set the slips.

Figure 15:
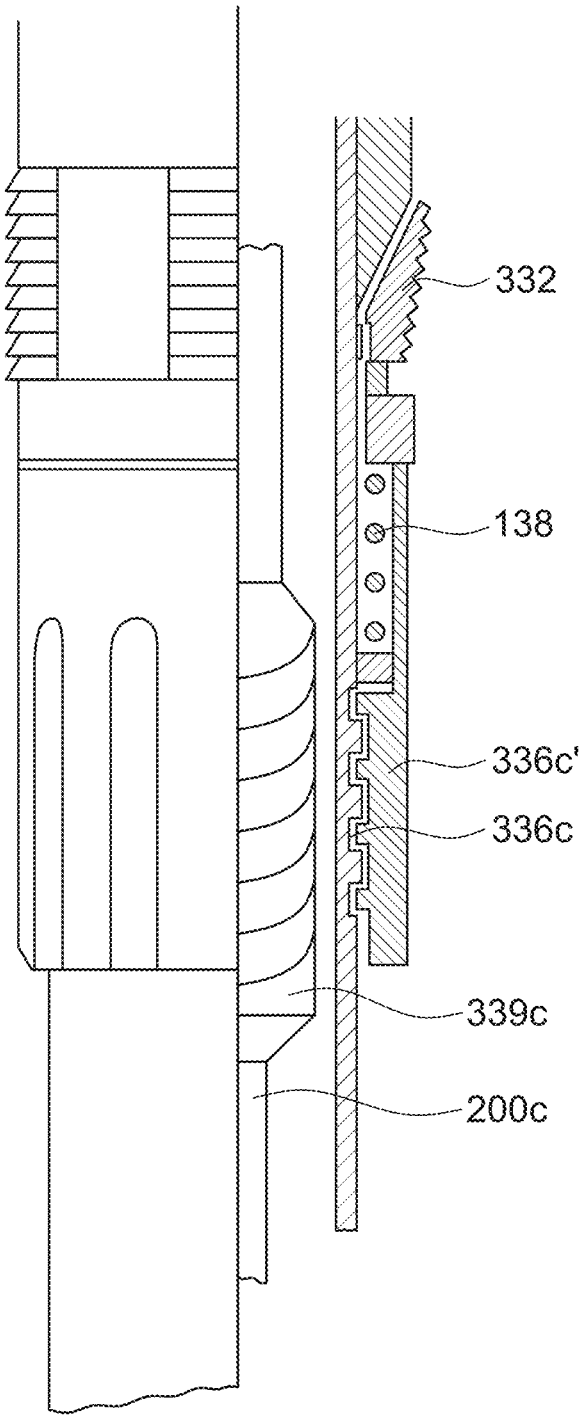
FIG. 15 is a cross section of another slip assembly.

With reference to FIG. 15, another embodiment is shown that uses a lock 336*c* that is responsive to an electronic magnet 339*c* that is carried on a running tool 200*c* with a battery pack and switch. The lock 336*c* includes a lock profile on liner hanger and a lock sleeve 336*c*' releasably engaged thereto. When magnet 339*c* is moved past the lock, the lock sleeve disengages from the lock profile and slips 332 that are carried on lock sleeve 336*c*', can be driven by spring 138 to set.

Again with the signaling embodiments, no leak path is created through the wall of body 140, 340. Further, the liner hanger can be set in the well without moving the liner hanger itself axially through the well.

Packing Element Setting

As will be appreciated, the liner hanger has other structures for operation downhole. For example, regardless of the means for setting the initial slips, as noted above the liner hanger may include annular packing element 165. That packing element requires a system for setting it, after the initial slips are set. In one embodiment, the packing element can be set by a secondary slip assembly 150, having slips 152 that ride along frustoconical member 154. A convenient way to set the slips is via running tool 200. As noted above, the running tool may be connected via a first connection 148 on the body mateable with a second connection 208 on the running tool. In one embodiment, the connections may be threaded, as shown, or other releasable connections may be employed.

The liner hanger may include a setting sleeve 110, which may be elongate, hollow, and substantially cylindrical about a long axis x, extending from a sleeve upper end 112 to a sleeve lower end 114. In one embodiment, the secondary slip assembly 150 may be disposed axially below the sleeve lower end 114, radially outward and separate from body 140, axially above step 143 and/or radially inward from the tie rod. Slips 152 are radially expandable to contact the casing when the secondary slips are compressed axially together by the setting sleeve. In one embodiment, the running tool applies a force down on the sleeve upper end 112 to cause the secondary slips to set.

Setting sleeve 110 may be disposed around body 140, e.g., concentrically around the body. Body upper end 142 may be axially below sleeve upper end 112. Body lower end 144 may be axially below sleeve lower end 114. The setting sleeve may extend from sleeve upper end 112, above the axial upper end of the body, and the setting sleeve may terminate partway down a length of the body.

Figure 11:
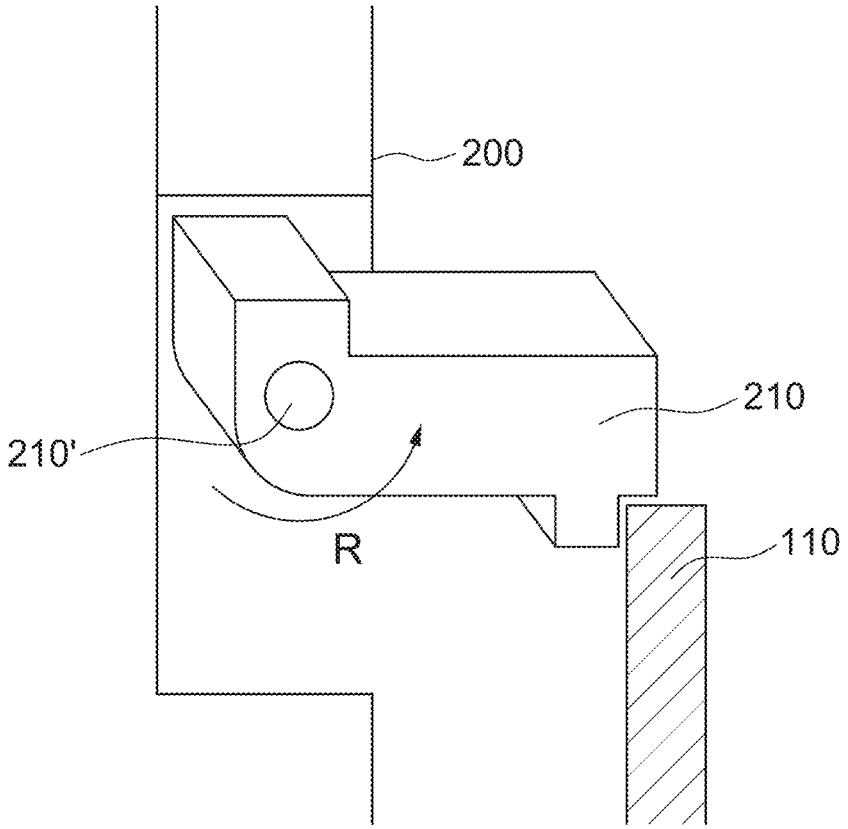
FIG. 11 is a perspective view of a lug according to one embodiment.

With reference to FIGS. 2A, 2B and 11, in one embodiment running tool 200 may include lugs 210, which may also be referred to as dogs or setting dogs. When not required, such as when running the liner hanger into the well and setting it (FIG. 2A), push lugs 210 are retracted inside the liner hanger. Each lug may be pivotably coupled at connection 210' to the running tool, e.g., proximate upper end 202. The lug may be configured to flip outward, rotation R, when it is removed from upper end of the liner hanger. In particular, when running tool 200 is disengaged and pulled up out of the liner hanger, lugs 210 rotate out such that the lugs protrude out above and radially beyond the upper end 112 of the setting sleeve. Lugs 210 can therefore rest on upper end 112 of setting sleeve 110. Weight can be applied on the setting sleeve by slacking off on the running tool and drill string, which may push the setting sleeve down, break and set the secondary slips, compress element 165, and set the liner hanging.

Thereafter, lugs 210 may be retractable such that when the lugs are pulled a distance above the setting sleeve, the lugs reset into their retracted position against running tool 200.

Multiple lugs, e.g., four lugs, may be spaced circumferentially around the running tool. The lugs may be axially aligned, and distributed substantially radially equidistant from one another.

Packing element 165 may be disposed around the body such that it can create a seal between the body and casing 510. The element 165 may be made of rubber, expandable metal, or another suitable material selected such that an outer diameter of the element is increasable, e.g., under axial pressure and/or changes in temperature and/or pressure. The body may include a step 143 extending radially outward, and the element may be disposed proximate, e.g., on the step. In one embodiment, element 165 is compressed between the step and the secondary slip assembly, when set.

The running tool may include a tool seal 212, which may include an o-ring, configured to create a seal between the running tool and the body, and sized to prevent axial fluid communication above and below the tool seal.

The running tool may include a clutch 171 engageable with a swivel 170 for rotating the liner, and components attached thereto, independent from the slips, to promote cement coverage during cementing. The swivel may be integral to the liner hanger or installed below.

Figure 25:
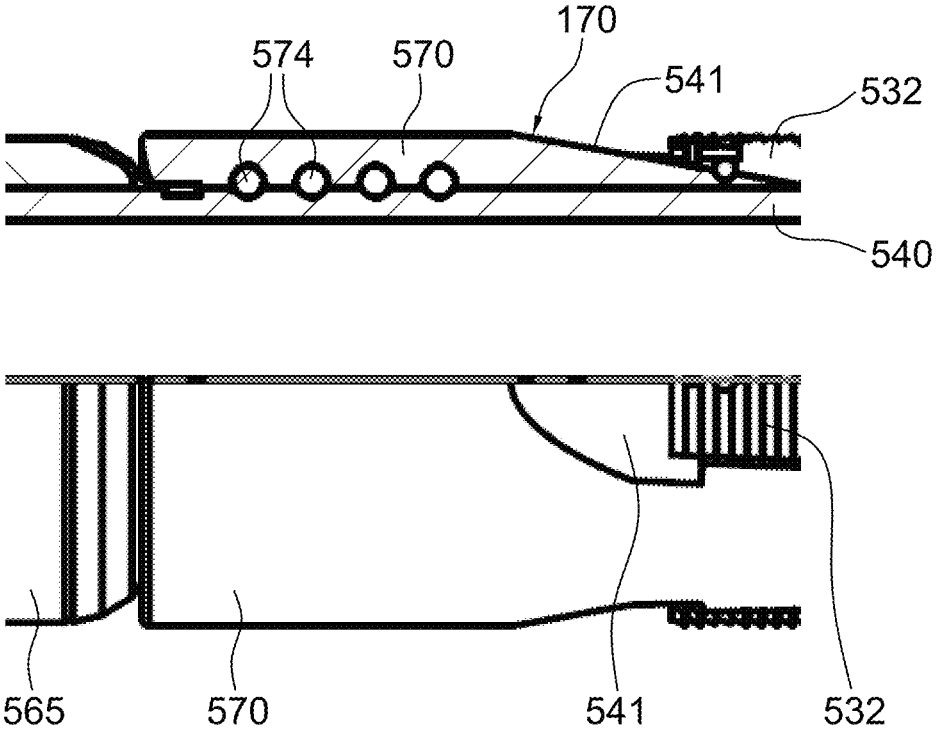
FIG. 25 is a section through a liner hanger with an integral swivel.

One embodiment of a swivel 170 for integration to a liner hanger is illustrated in FIG. 25. The swivel includes an outer annular swivel body 570 encircling the liner hanger mandrel body 540. Bearings 574 are positioned between the outer annular swivel body 570 and body 540. Outer annular swivel body 570 may be configured to define the tapering surface 541 along which lower initial setting slips 532 expand and set. Outer annular swivel body 570 may therefore be positioned axially between annular packing element 565 and the lower end of the liner hanger. With such a swivel, after slips 532 are set, bearings 574 permit the liner hanger body to rotate within outer annular swivel body 570 until packing element 565 is set.

If an integral swivel is run, the liner can be rotated via torque applied to the liner hanger mandrel body 540. As noted, the running tool may be configured to apply the torque.

Methods

A method for installing a liner hanger according to the invention, may include lowering an assembly including the running tool and the liner hanger into the casing. When the assembly is lowered to the desired position in the casing, the slip setting system is actuated to set the initial, lower setting slips 32, 132, 232, 332, 432, 532.

As noted above, this setting operation is conducted through a solid liner hanger body/mandrel wall 40, 140, 340, 440, 540 which is devoid of hydraulic perforations. For example, the setting can be by use of tie rods 120, 220, by movement of body wall, for example, via internal expansion of a smaller diameter region 455, 455' to change the outer diameter dimension or length of the body or by signaling via a magnetically responsive systems 336*a*, 338, 352, radio frequency, etc. As such, because the body wall is free of hydraulic ports and elastomerically sealed interfaces there-through, the slips are set without leaving a possible leak path through the body/mandrel wall of the liner hanger.

In addition, the setting operation can be conducted while the liner hanger remains substantially static in the wellbore.

Cement may be introduced through the liner hanger, through the liner attached to the liner hanger and up into the annulus between the liner/liner hanger and the casing. To facilitate cementing, the running tool clutch 171 can be engaged into the swivel 170 and can drive rotation of the liner relative to the swivel outer body 570. Rotation of the liner facilitates even distribution of cement in the annulus.

When cementing is complete, the packing element 65, 165, 565 may be set. Using the embodiment of FIGS. 2A, 2B, 10 and 11, running tool 200 may be lifted partially out of the liner hanger body and setting sleeve 110, such that the dogs 210 may flip out and rest and/or be forced down onto the setting sleeve. Under the force of the setting sleeve, the packer element and secondary slips 150 may be engaged to expand them out thereby creating a tight seal between the liner hanger body and the casing. The slips 150 are locked in the set position to retain a compressive force on the packing element. The running tool may be removed, which may include decoupling the running tool from the body. The dogs may retract into their retracted position.

References to orientations, e.g., "upper," "lower," "upward," "downward," "top," "bottom," etc., are understood to be illustrative of optional relative orientations, and not limitations restricting the scope of the invention to such orientations. References in the specification to "one embodiment", "an embodiment", etc., indicate that the embodiment described may include a particular aspect, feature, structure, or characteristic, but not every embodiment necessarily includes that aspect, feature, structure, or characteristic. Moreover, such phrases may, but do not necessarily, refer to the same embodiment referred to in other portions of the specification. Further, when a particular aspect, feature, structure, or characteristic is described in connection with an embodiment, it is within the knowledge of one skilled in the art to affect or connect such module, aspect, feature, structure, or characteristic with other embodiments, whether or not explicitly described. In other words, any module, element or feature may be combined with any other element or feature in different embodiments, unless there is an obvious or inherent incompatibility, or it is specifically excluded. It is further noted that the claims may be drafted to exclude any optional element or step. As such, this statement is intended to serve as antecedent basis for the use of exclusive terminology, such as "solely," "only," and the like, in connection with the recitation of claim elements or use of a "negative" limitation. The terms "preferably," "preferred," "prefer," "optionally," "may," and similar terms are used to indicate that an item, condition or step being referred to is an optional (not required) feature of the invention. The singular forms "a," "an," and "the" include the plural reference unless the context clearly dictates otherwise. The term "and/or" means any one of the items, any combination of the items, or all of the items with which this term is associated. The phrase "one or more" is readily understood by one of skill in the art, particularly when read in context of its usage. The term "about" can refer to a variation of ±5%, ±10%, ±20%, or ±25% of the value specified. For example, "about 50" percent can in some embodiments carry a variation from 45 to 55 percent. For integer ranges, the term "about" can include one or two integers greater than and/or less than a recited integer at each end of the range. Unless indicated otherwise herein, the term "about" is intended to include values and ranges proximate to the recited range that are equivalent in terms of the functionality of the composition, or the embodiment. As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. A recited range includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc. As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims. All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A liner hanger, comprising:

a body including an inner bore, an outer surface, a wall between the inner bore and the outer surface and a tapered segment on an outer surface of the body;

a plurality of slips disposed on the outer surface of the body, the plurality of slips being actuatable to move from an unset position adjacent a small diameter end of the tapered segment to a set position on the tapered segment of the body to increase a diameter of the apparatus;

a locking mechanism to hold the plurality of slips in the unset position; and an actuation system to unlock the locking mechanism, wherein the actuation system involves mechanisms of operation other than hydraulic fluid communication through the wall, such that the body is thereby free of hydraulic ports extending through the wall and wherein the actuation system responds to a signal generated from within the body, which is a movement of the body driven by a radial expansion of the wall to impart an outer diameter change to the body or a length change of the body.

2. The liner hanger of claim 1, wherein the actuation system operates while the liner hanger is static within the wellbore.

3. The liner hanger of claim 1, wherein the actuation system is controlled by a running tool for the liner hanger.

4. The liner hanger of claim 3, wherein the actuation system is a mechanical structure including an upper end coupled to the running tool, a portion extending along the outer surface of the body and a lower end coupled to the plurality of slips, wherein actuation of the upper end by the running tool moves the plurality of slips.

5. The liner hanger of claim 1 further comprising a driver to drive the plurality of slips from the unset position to the set position, after the locking mechanism is unlocked.

6. The liner hanger of claim 1, wherein the actuation system includes at least one tie rod coupled to apply a pull force to the plurality of slips.

7. The liner hanger of claim 6, wherein the locking mechanism includes an exterior recess on the body mateable with a ball, the ball being initially held by an end of the at least one tie rod between one of the plurality of slips or a slip carrier for the plurality of slips and the exterior recess such that when the tie rod is actuated to apply a pull force, the ball is free to move out of engagement with the recess.

8. The liner hanger of claim 1, further comprising a swivel including a swivel outer housing encircling the body, the swivel outer housing defining the tapered segment on which the plurality of slips set.

9. A liner hanger assembly comprising the liner hanger of claim 1 and a running tool configured to support the body.

10. The liner hanger assembly of claim 9, wherein the liner hanger further comprises an annular packing element and the running tool includes a cylinder for applying a force against a setting sleeve for the liner hanger.

11. A liner hanger, comprising:

a body including an inner bore, an outer surface, a wall between the inner bore and the outer surface and a tapered segment on an outer surface of the body;

a plurality of slips disposed on the outer surface of the body, the plurality of slips being actuatable to move from an unset position adjacent a small diameter end of the tapered segment to a set position on the tapered segment of the body to increase a diameter of the apparatus;

a locking mechanism to hold the plurality of slips in the unset position; and an actuation system to unlock the locking mechanism, wherein the actuation system involves mechanisms of operation other than hydraulic fluid communication through the wall, such that the body is thereby free of hydraulic ports extending through the wall; and wherein the actuation system includes at least one tie rod coupled to apply a pull force to the plurality of slips and wherein the locking mechanism includes an exterior recess on the body mateable with a ball, the ball being initially held by an end of the at least one tie rod between one of the plurality of slips or a slip carrier for the plurality of slips and the exterior recess such that when the tie rod is actuated to apply a pull force, the ball is free to move out of engagement with the recess.

12. A liner hanger assembly comprising the liner hanger of claim 11 and a running tool configured to support the body.

13. The liner hanger assembly of claim 12, wherein the liner hanger further comprises an annular packing element and the running tool includes a cylinder for applying a force against a setting sleeve for the liner hanger.

* * * * *